US006412549B1

(12) United States Patent
Itoh et al.

(10) Patent No.: US 6,412,549 B1
(45) Date of Patent: Jul. 2, 2002

(54) HEAT TRANSFER PIPE FOR REFRIGERANT MIXTURE

(75) Inventors: Masaaki Itoh; Mari Uchida; Mitsuo Kudoh, all of Tsuchiura; Tadao Otani, Ibaraki-Ken, all of (JP)

(73) Assignees: Hitachi, Ltd.; Hitachi Cable, Ltd., both of Tokyo (JP)

( * ) Notice: Subject to any disclaimer, the term of this patent is extended or adjusted under 35 U.S.C. 154(b) by 486 days.

(21) Appl. No.: 08/580,256

(22) Filed: Dec. 28, 1995

(30) Foreign Application Priority Data

Dec. 28, 1994 (JP) ..... 6-326646

(51) Int. Cl.[7] ..... F28F 1/14

(52) U.S. Cl. ..... 165/184; 165/133; 165/181; 165/179

(58) Field of Search ..... 165/184, 181, 165/133, 179

(56) References Cited

U.S. PATENT DOCUMENTS

| | | | | |
|---|---|---|---|---|
| 4,733,698 A | | 3/1988 | Sato | |
| 5,052,476 A | * | 10/1991 | Sukumoda et al. | 165/184 X |
| 5,332,034 A | * | 7/1994 | Chiang et al. | 165/184 |
| 5,458,191 A | * | 10/1995 | Chiang et al. | 165/184 X |
| 5,975,196 A | * | 11/1999 | Gaffaney et al. | 165/133 |

FOREIGN PATENT DOCUMENTS

| | | | | |
|---|---|---|---|---|
| EP | 0603108 | * | 6/1994 | 165/181 |
| GB | 1001630 | * | 8/1965 | 165/184 |
| JP | 0119192 | * | 7/1984 | 165/184 |
| JP | 0175485 | * | 8/1986 | 165/184 |
| JP | 3207995 | * | 9/1991 | 165/184 |
| JP | 6101985 | * | 4/1994 | 165/184 |

OTHER PUBLICATIONS

Japanese Patent Unexamined Publication No. 3–234302 Feb. 13, 1990.

* cited by examiner

*Primary Examiner*—Christopher Atkinson
(74) *Attorney, Agent, or Firm*—Antonelli, Terry, Stout & Kraus, LLP

(57) ABSTRACT

To provide a high heat transfer performance with a heat transfer pipe used to a condenser and an evaporator in a refrigerating cycle using a refrigerant mixture, the heat transfer pipe includes main grooves and auxiliary grooves each formed on the inner surface of the heat transfer pipe with the main grooves intersecting the auxiliary grooves, wherein the main grooves are separate by ridges, and the ridges are divided into ribs by the auxiliary grooves, and wherein a length of the ribs formed along the direction of the main grooves is made longer than the length of the ridges, a width of the auxiliary grooves is made smaller than the length of the ribs and further the auxiliary grooves are formed in a direction where a pressure gradient in the heat transfer pipe is reduced.

4 Claims, 12 Drawing Sheets

HEAT TRANSFER PIPE FOR REFRIGERANT MIXTURE

BACKGROUND OF THE INVENTION

1. Field of the Invention

The present invention relates to a heat exchanger used for refrigerators and air conditioners using a refrigerant mixture as an operating fluid, and more specifically, to a condenser, an evaporator and a heat transfer pipe preferably used for them.

2. Description of the Related Art

A pipe having spiral grooves each composed of a single groove and formed on the inner surface thereof (hereinafter, referred to as a pipe with spiral grooves) as shown in FIG. 17 is used as a heat transfer pipe of a heat exchanger used by conventional refrigerators and air conditioners using a single refrigerant such as HCFC-22 (hydrochlorofluorocarbon-22) and the like as an operating fluid, in addition to a flat pipe.

Although the pipe with spiral grooves has an excellent heat transfer performance to a single refrigerant, when a refrigerant mixture which is considered hopeful as a refrigerant substituting for HCFC-22 is used to the pipe, it cannot achieve such a degree of effect as that to the single refrigerant. FIG. 18 is a graph comparing a condensation heat transfer coefficient when the conventional pipe with spiral grooves uses the single refrigerant with that when the conventional pipe uses the refrigerant mixture. That is, a curve a shows a result of experiment when the single refrigerant was used by the pipe with spiral grooves and a curve b shows a result of experiment when the refrigerant mixture was used by the pipe. As apparent from FIG. 18, the condensation heat transfer coefficient when the refrigerant mixture was used is apparently reduced as compared with the case in which the single refrigerant was used, and this reduction is remarkable when a mass velocity is slow. Note, a mixture composed of 30 wt % of HFC-32 (hydrofluorocarbon 32), 10 wt % of HFC-125 and 60 wt % of HFC-134*a* was used as the refrigerant mixture in the experiment.

Further, JP-A-3-234302 discloses a pipe with cross grooves composed of two types of grooves or main grooves and auxiliary grooves intersecting the main grooves as a heat transfer pipe to be used to the single refrigerant. Although there are proposed heat transfer pipes having various internal configurations other than the above as heat transfer pipes for the single refrigerant, it has not been conventionally known what type of an internal configuration is most efficient as the configuration of a heat transfer pipe for zeotropic refrigerant mixture.

SUMMARY OF THE INVENTION

An object of the present invention is to provide a heat transfer pipe having a high heat transfer performance to the refrigerant mixture.

To achieve the above object, the present invention provides a heat transfer pipe used for a condenser and an evaporator in a refrigerating cycle using a refrigerant mixture, the heat transfer pipe comprising main grooves and auxiliary grooves each formed on the inner surface of the heat transfer pipe with the main grooves intersecting the auxiliary grooves, wherein a length of ribs, which are divided into sections by the auxiliary grooves, of ridges formed along the direction of the main grooves is made longer than a width of the ridges, a width of the auxiliary grooves is made smaller than the length of the ribs and further the auxiliary grooves are formed in a direction where a pressure gradient in the heat transfer pipe is reduced.

In the heat transfer pipe, the auxiliary grooves may be formed at a spiral angle in a range of ±5° with respect to a pipe axis and further they are preferably formed substantially in parallel with a pipe axis.

Further, in the heat transfer pipe, convex deformed portions may be formed to each of the ribs of the main grooves to cause a refrigerant flow along the main grooves to bend in the direction of the auxiliary grooves.

Note, in the above respective heat transfer pipes, the main grooves are formed by being inclined at an angle in a range from 7° to 25° with respect to the pipe axis.

With the above arrangements, since a refrigerant flow is induced so as to be bent in the direction of the auxiliary grooves and taken into the auxiliary grooves of which the width is narrower than the length of the ribs in the heat transfer pipe of the present invention, concentration boundary layers are divided into sections and new concentration boundary layers are formed from the extreme ends of the respective ribs. As a result, a high heat transfer coefficient can be realized to a refrigerant mixture without substantially reducing a heat transfer area.

DESCRIPTION OF PREFERRED EMBODIMENTS

Figure 17:
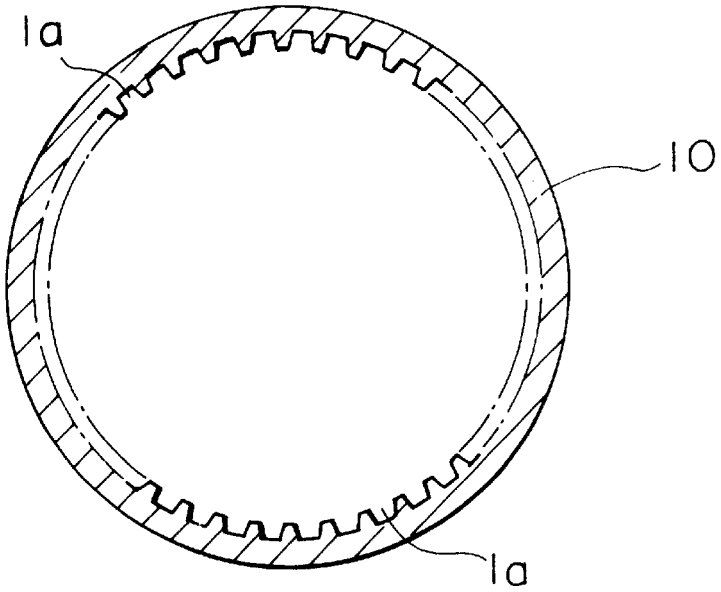
FIG. 17 is a lateral cross sectional view of a conventional heat transfer pipe.
Figure 18:
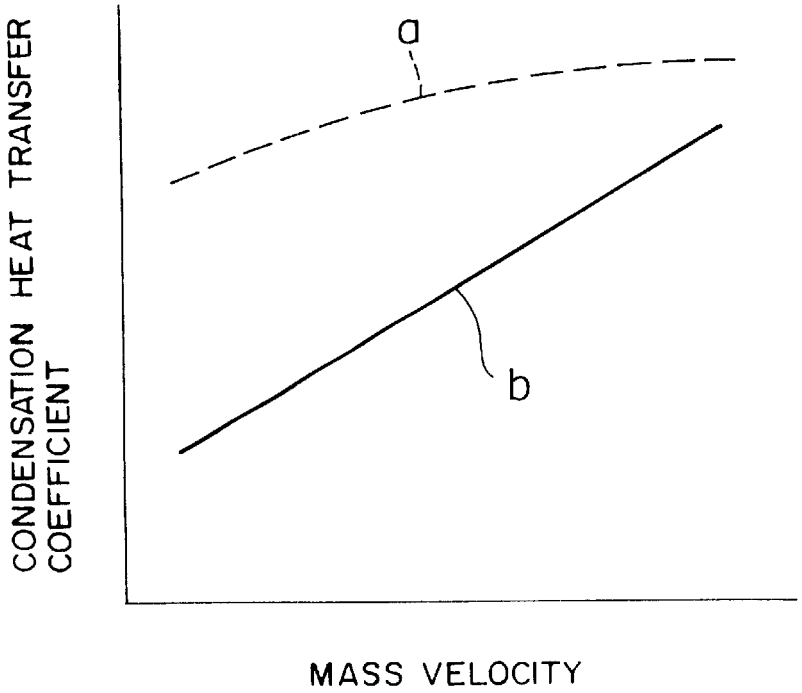
FIG. 18 is a graph comparing the performance of the conventional heat transfer pipe when it uses a single refrigerant with that of the-conventional heat transfer pipe when it uses a refrigerant mixture.
Figure 19:
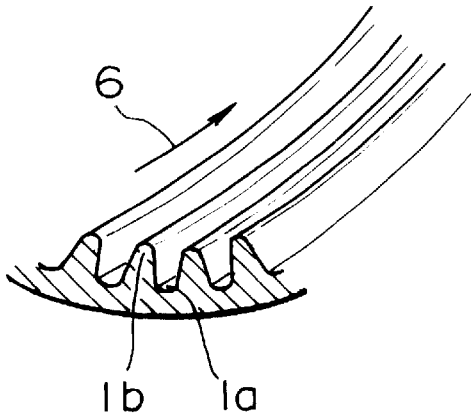
FIG. 19 is a perspective view showing a refrigerant flow in the vicinity of grooves of the conventional heat transfer pipe.

Prior to the description of the embodiments according to the present invention, a phenomenon which is a problem caused by prior art will be described below with reference to FIG. 17 to FIG. 21. FIG. 17 is a lateral cross sectional view of a pipe with spiral grooves formed on the inner surface thereof used for an ordinary air conditioning heat exchanger. There will be discussed a case wherein a refrigerant mixture (for example, a refrigerant mixture composed of three types of refrigerants or, for example, HFC-32, HFC-125 and HFC-134*a*) flows in the pipe with grooves and condenses.

Figure 20:
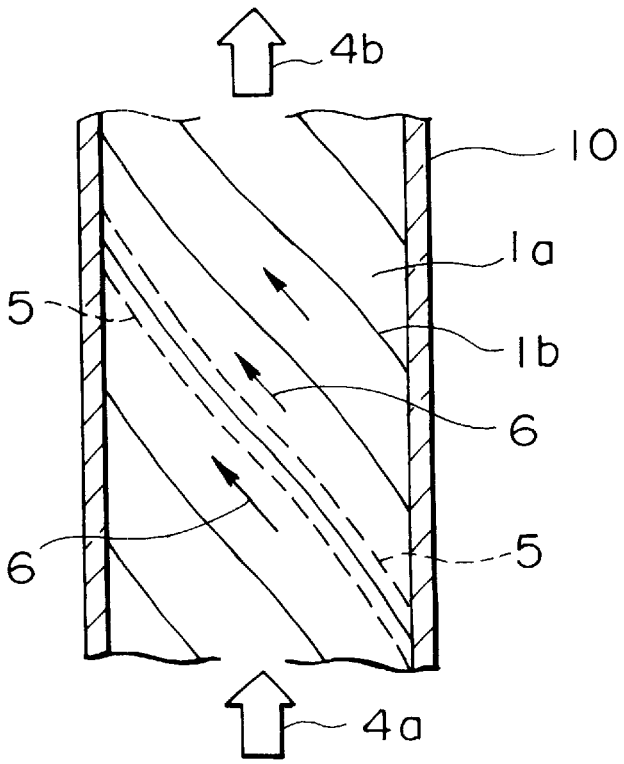
FIG. 20 is a longitudinal cross sectional view of the conventional heat transfer pipe.

FIG. 20 shows a direction in which a refrigerant gas flows in the pipe. Although the refrigerant gas in the vicinity of the center of the pipe flows in the direction from a refrigerant inlet 4*a* to a refrigerant outlet 4*b*, the refrigerant gas near to a pipe wall flows in the direction of main grooves la by being guided by the main grooves la and the ridges 1*b* thereof.

Figure 21:
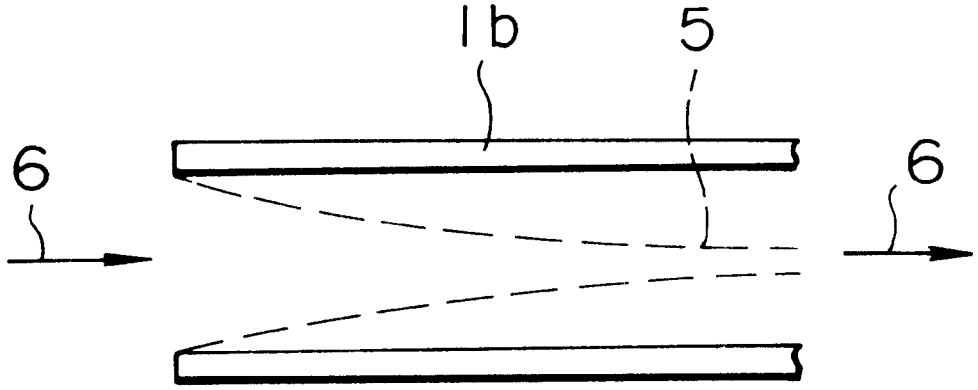
FIG. 21 is a view showing concentration boundary layers between the grooves of the conventional heat transfer pipe.

Since there exist a relatively-easy-to-condense refrigerant and a relatively-difficult-to-condense refrigerant in the refrigerant mixture, the former refrigerant condenses and liquefies first and the latter refrigerant remains as it is to form concentration boundary layers. As shown in FIG. 20, the concentration boundary layers 5 are formed along the main grooves 1*a*. Since the concentration boundary layers 5 are continuously formed, they become gradually thick as shown in FIG. 21 and act to prevent the relatively-easy-to-condense refrigerant from diffusing to a pipe wall. As a result, a condensation heat transfer coefficient is reduced.

It is effective to divide the concentration boundary layers 5 into sections to improve the reduction of the condensation heat transfer coefficient in the refrigerant mixture which is a problem of prior art. To cope with this problem, this application proposes a pipe with cross grooves. As shown in a first embodiment of a heat transfer pipe according to the present invention of FIG. 1, the pipe with cross grooves has main grooves la and auxiliary grooves 2*a* intersecting the main grooves 1*a*, both of them being formed on the inner surface of the pipe the ridges 1*b* formed by the provision of the main grooves 1*a* being divided into sections by the formation of the auxiliary grooves 2*a* intersecting the main grooves 1*a* to thereby form three-dimensional ribs 3. Each of the ribs 3 has a length longer than the width thereof as well as each of the auxiliary grooves has a width made smaller than the length of the ribs and the width of each of the main grooves so as to increase an amount of flow of the refrigerant along the direction of the main grooves. The auxiliary grooves 2*a* are formed in such a direction as to cause the refrigerant to flow from a refrigerant inlet 4*a* to a refrigerant outlet 4*b* and a pressure gradient of the refrigerant to be reduced at the center of the pipe.

Figure 1:
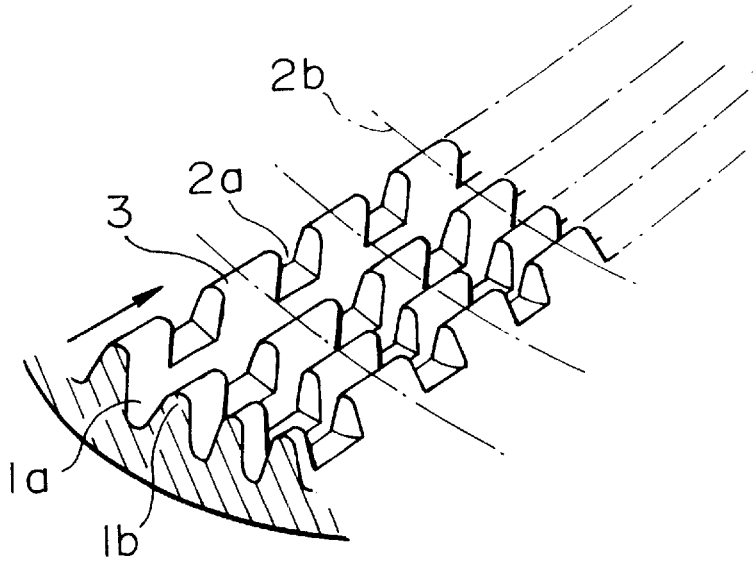
FIG. 1 is a view showing a refrigerant flow in the vicinity of the grooves of a first embodiment of a heat transfer pipe with cross grooves according to the present invention.
Figure 2:
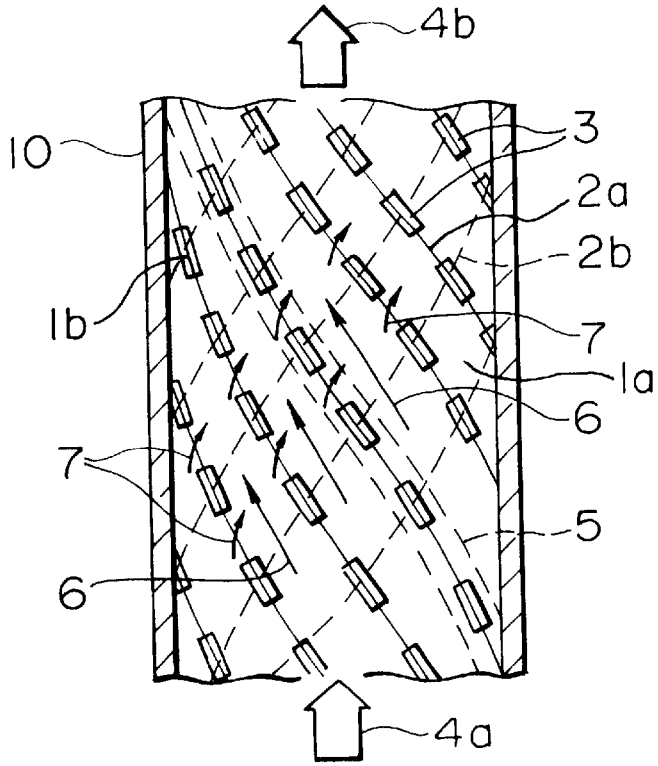
FIG. 2 is a longitudinal cross sectional view of the heat transfer pipe with cross grooves of FIG. 1.

FIG. 2 is a longitudinal cross sectional view of the pipe with cross grooves shown in FIG. 1 and an arrow 6 shows a direction in which the refrigerant flows. That is, the ridges 1*b* of the main grooves 1*a* are divided into sections by the auxiliary grooves 2*a* and form the three-dimensional ribs 3 which have a direction in coincidence with the direction of the main grooves 1*a*. Thus, almost all the refrigerant flows in the direction 6 of the wide main grooves 1*a* which are surrounded on both sides by the long ridges and the remaining refrigerant flows in the direction of an arrow which is the direction of the auxiliary grooves 2*a*. Consequently, some refrigerant flows in the direction of the auxiliary grooves as shown in FIG. 2, so that the deterioration of performance of the refrigerant mixture is improved.

Figure 3:
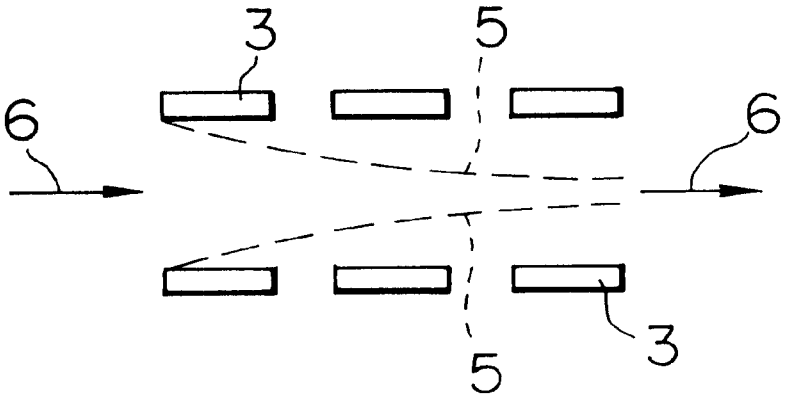
FIG. 3 is a view showing concentration boundary layers between the grooves of the heat transfer pipe with cross grooves of FIG. 2.

However, as shown by the concentration boundary layers 5 in FIG. 3 formed along the three-dimensional ribs 3 in FIG. 2, when the width of the auxiliary grooves is narrow, since the concentration boundary layers are gradually made thick, as in the case of a single groove, the effect of the three-dimensional ribs that the flow of the refrigerant along the main grooves is divided into sections cannot be sufficiently exhibited.

Figure 4:
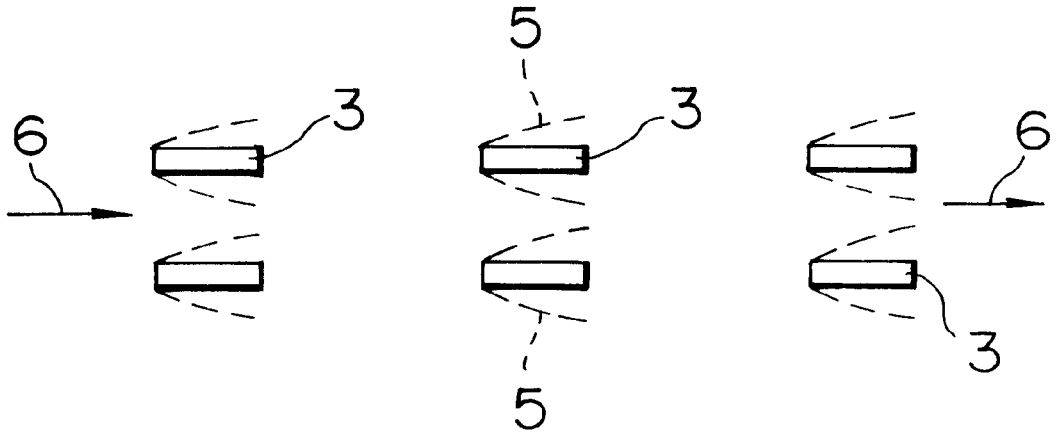
FIG. 4 is a view showing concentration boundary layers between the grooves of a heat transfer pipe with cross grooves having wide intervals between ribs in the direction of the ridges.

Note, to exhibit the effect of the three-dimensional ribs 3, there is a method of providing a large distance between the ribs by making the width of the auxiliary grooves larger than the length of the ribs as shown in FIG. 4. With this arrangement, concentration boundary layers are newly formed from the extreme ends of the three-dimensional ribs. However, this method is not so recommendable because a heat transfer area is reduced on the contrary so as not to improve overall performance greatly.

A structure of a heat transfer pipe capable of inducing a refrigerant flow 7 along auxiliary grooves 2*b* even if the auxiliary grooves 2*b* have a narrow width will be described below with reference to a more preferable embodiment according to the present invention.

Figure 5:
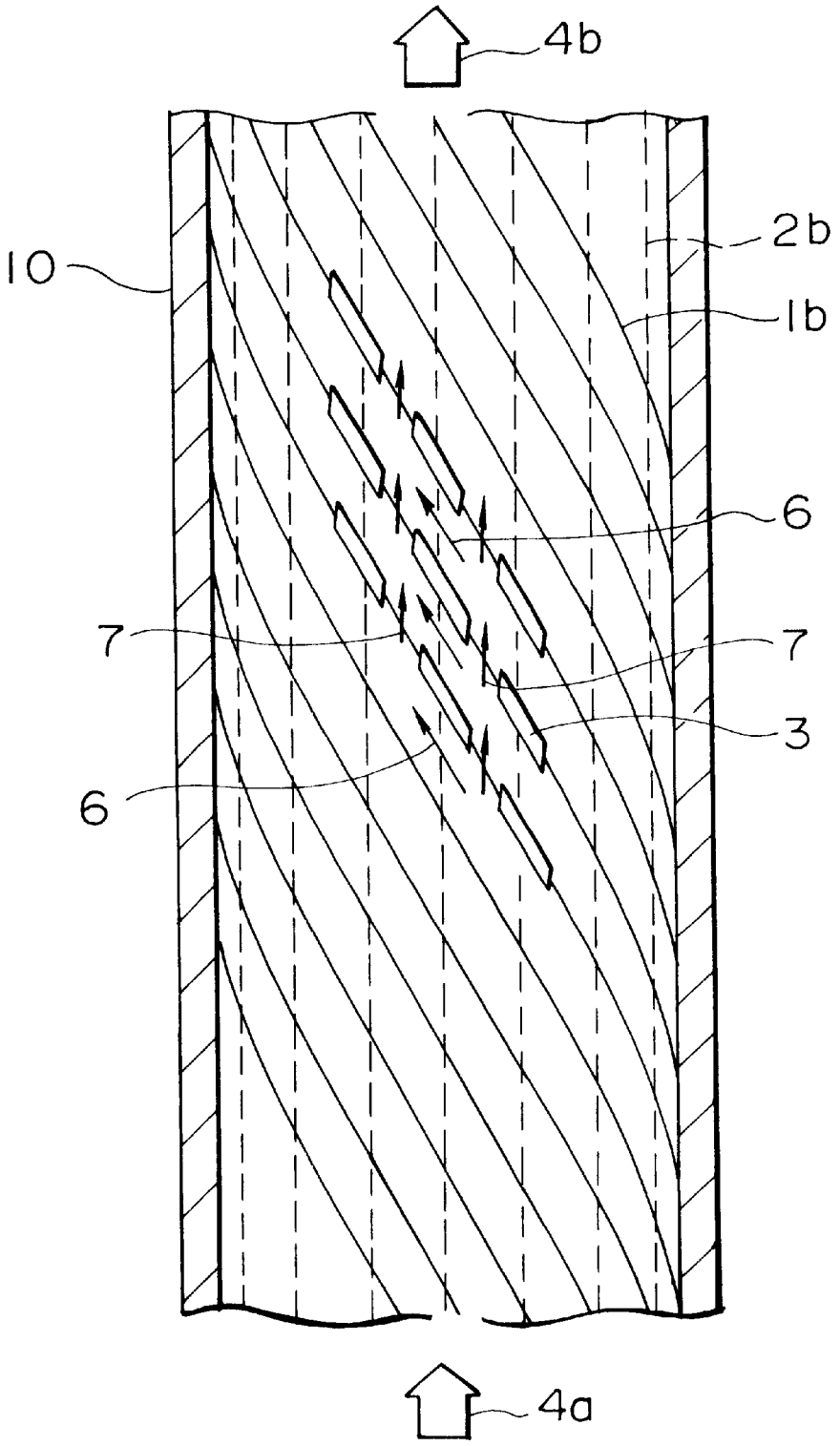
FIG. 5 is a longitudinal cross sectional view showing a second embodiment of the heat transfer pipe with cross grooves according to the present invention.
Figure 6:
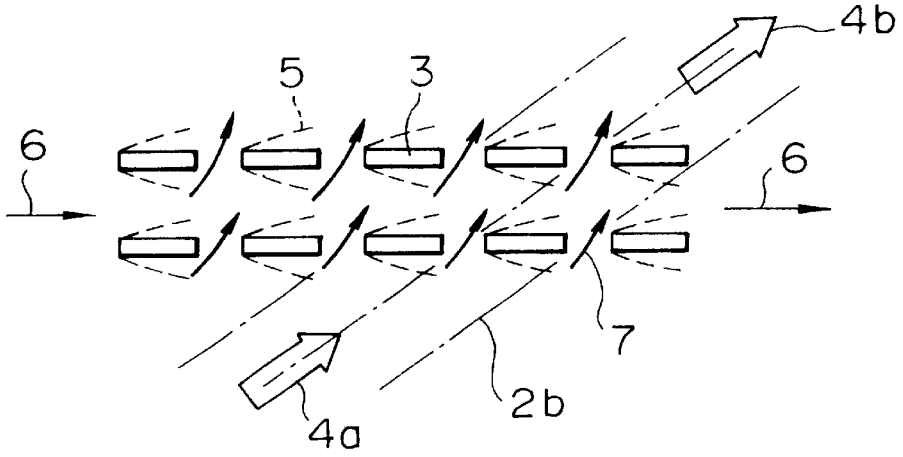
FIG. 6 is a view showing concentration boundary layers between the grooves of the heat transfer pipe with cross grooves of FIG. 5.

A second embodiment according to the present invention will be described with reference to FIG. 5 and FIG. 6. FIG. 6 is a view showing concentration boundary layers between the grooves of a pipe with cross grooves of this embodiment. As apparent from FIG. 6, auxiliary grooves 2*b* are disposed in parallel with a pipe axis. A refrigerant flowing in the vicinity of the center of the heat transfer pipe flows in the direction from a refrigerant inlet 4*a* to a refrigerant outlet 4*b* and this direction coincides with the direction of the pipe axis. Consequently, the refrigerant tends to flow in the direction of the pipe axis. The parallel arrangement of the auxiliary grooves 2*b* with the pipe axis increases an amount of the refrigerant flowing in the auxiliary grooves, so as to divide the concentration boundary layers formed in the direction 6 of main grooves 1*a*. Therefore, new concentration boundary layers 5 are formed from respective three-dimensional ribs 3, respectively as shown in FIG. 6, thereby obtaining a high condensation heat transfer coefficient. At the time, the refrigerant near to a pipe wall flows in the auxiliary grooves disposed along the pipe axis, as shown in FIG. 5 which is a longitudinal cross sectional view of the heat transfer pipe.

Figure 7:
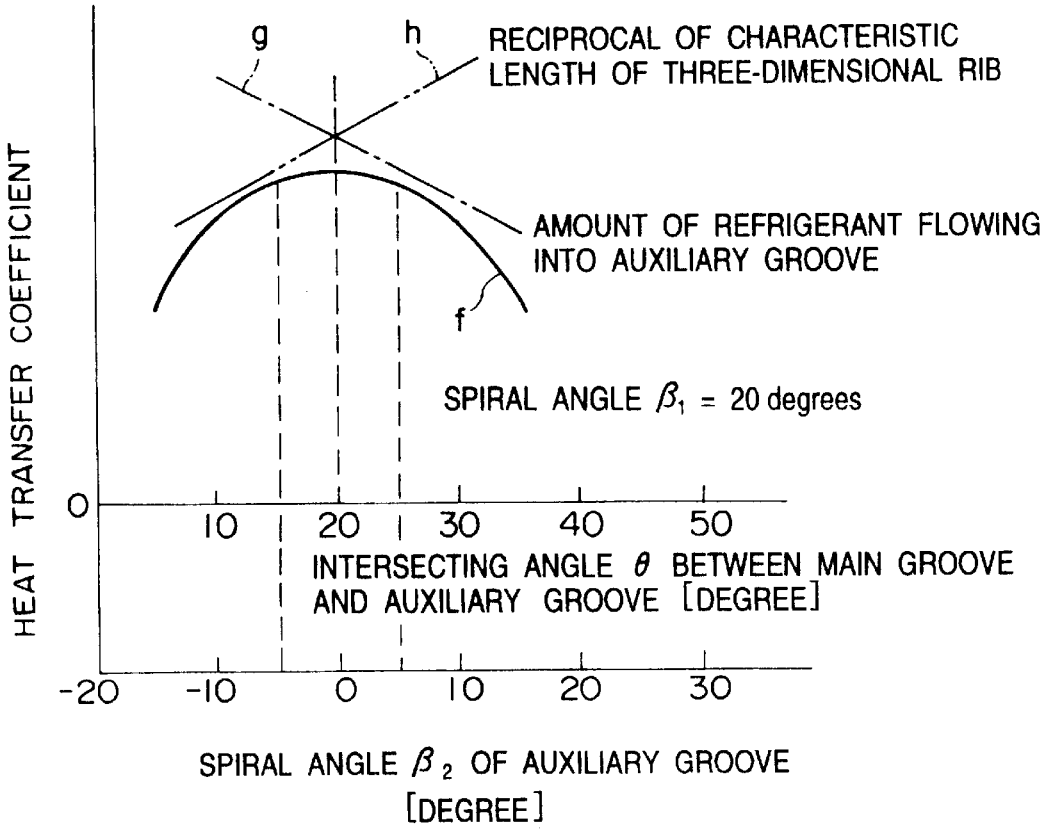
FIG. 7 is a graph showing the relationship between the spiral angle of auxiliary grooves and a heat transfer coefficient in the second embodiment of the present invention.

The relationship between the main grooves and the auxiliary grooves according to the present invention will be discussed here. When it is supposed that the main grooves have a spiral angle β1 of 20°, a heat transfer coefficient is represented by a curve f shown in FIG. 7 wherein the abscissa represents an intersecting angle θ between the main grooves and the auxiliary grooves or a spiral angle β2 of the auxiliary grooves. The curve f has a maximum value when the auxiliary grooves have the spiral angle β2 of 0°, that is, when the auxiliary grooves are parallel with the pipe axis. A reason why the curve f has the maximum value will be described below.

Figure 8:
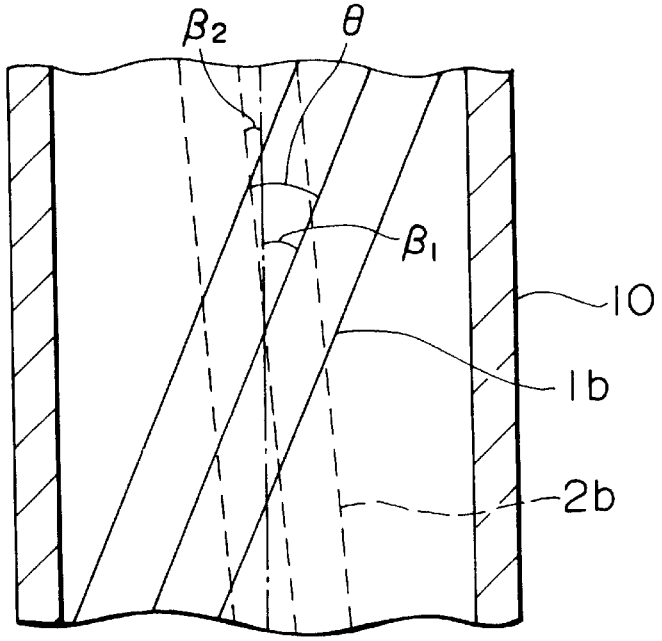
FIG. 8 is a view showing the relationship between an intersecting angle θ and a spiral angle β in the second embodiment of the present invention.

As shown by a curve q, an amount of the refrigerant flowing into the auxiliary grooves is increased as the intersecting angle θ between the main grooves and the auxiliary grooves is reduced, and the heat transfer coefficient is improved accordingly. However, when the spiral angle β2 of the auxiliary grooves is reduced and at last has a negative value, the main grooves do not almost intersect the auxiliary grooves as shown in FIG. 8. As a result, the characteristic length of the three-dimensional ribs increases and thus the heat transfer coefficient is reduced. This tendency is shown by a curve h in FIG. 7. Since the curve q has a tendency reverse to that of the curve h, the curve f is obtained by adding effects of both the curves and thus has the maximum value. Consequently, the spiral angle β2 of the auxiliary grooves need not be 0° in a strict meaning and a sufficiently high performance can be maintained by the spiral angle within a range of about ±5° from the pipe axis.

Figure 9:
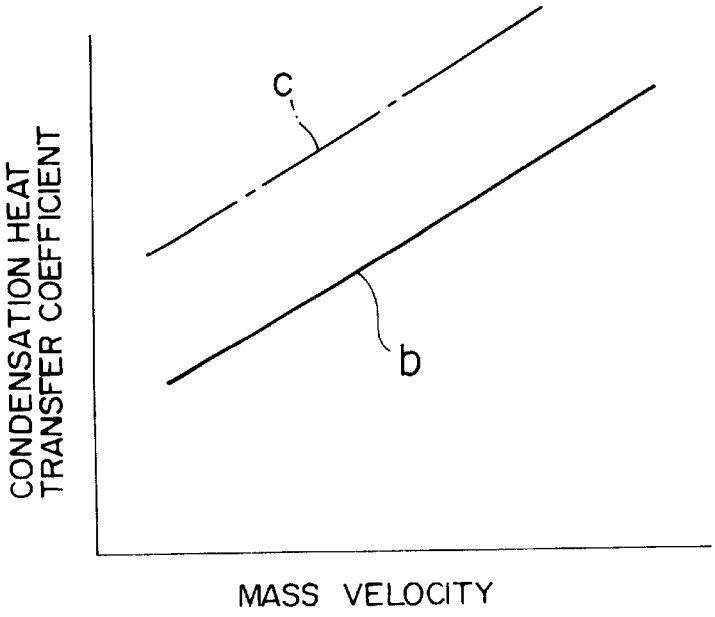
FIG. 9 is a graph comparing the performance of a conventional heat transfer pipe with a single groove with that of the heat transfer pipe with cross grooves according to the second embodiment of the present invention.

FIG. 9 shows an example of results obtained from the second embodiment according to the present invention, wherein a curve b shows a result of experiment of a conventional pipe with a single groove and a curve c shows a result of experiment of the pipe with the cross grooves according to the present invention. It is apparent from FIG. 9 that the heat transfer coefficient is improved in a wide range of a mass velocity.

Figure 10:
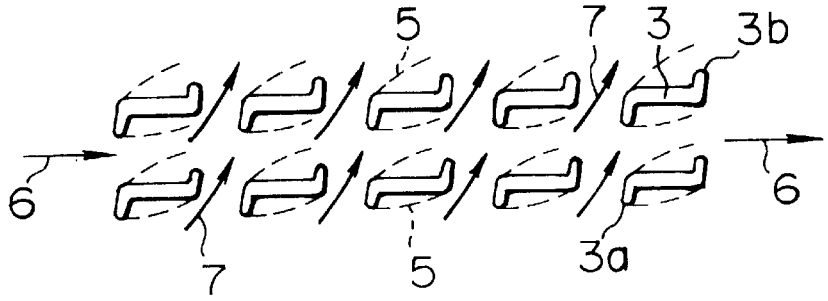
FIG. 10 is a view showing concentration boundary layers between the grooves of a third embodiment of the heat transfer pipe with cross grooves according to the present invention.
Figure 11:
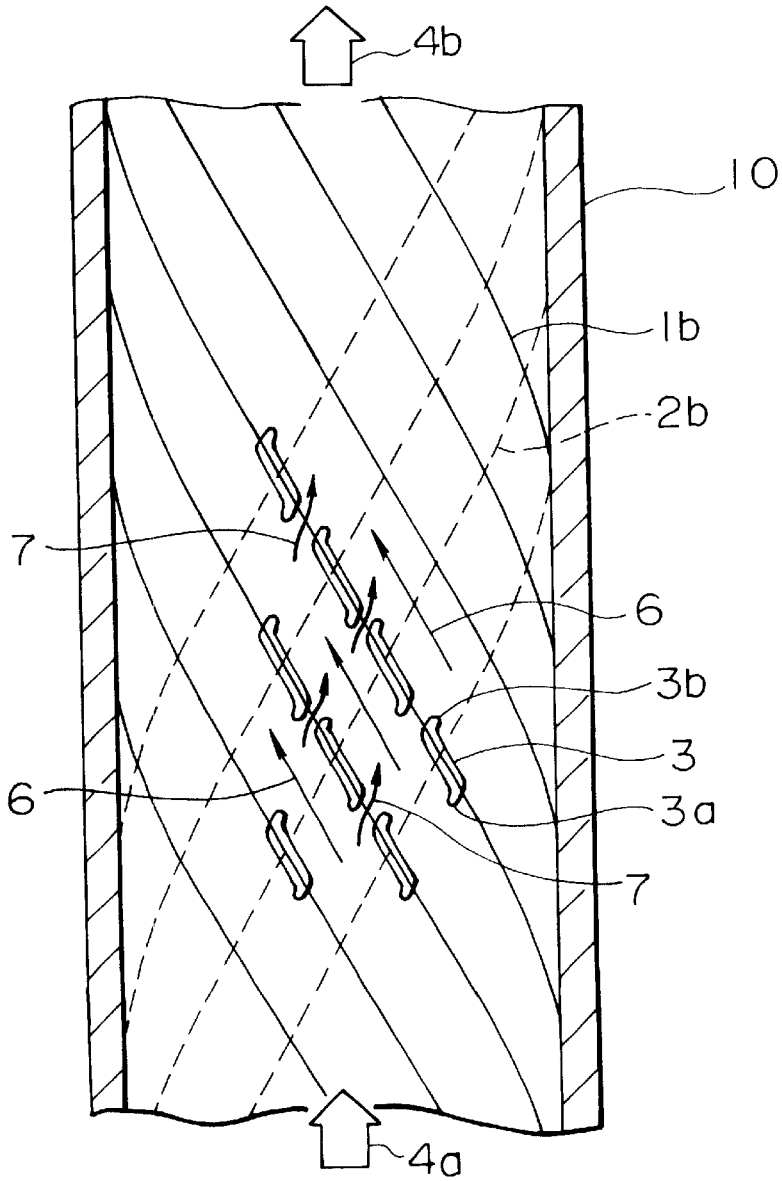
FIG. 11 is a longitudinal cross sectional view of the heat transfer pipe of the third embodiment according to the present invention.

A third embodiment according to the present invention will be described with reference to FIG. 10 and FIG. 11. FIG. 10 is a view showing concentration boundary layers between the grooves in a pipe with the cross grooves of this embodiment.

As shown in FIG. 10, this embodiment is arranged such that burrs 3*a*, 3*b* as convex deformed members are provided with each of three-dimensional ribs to induce a refrigerant flow. The burr 3*a* at the extreme end of the three-dimensional rib 3 faces in a direction opposite to that of the burr 3*b* at the rear end thereof so as to bend the refrigerant flow 6 along main grooves in the direction 7 of auxiliary grooves. FIG. 11 is a longitudinal cross sectional view of the heat transfer pipe and shows how the refrigerant flow 6 along the main grooves is bent in the direction 7 of the auxiliary grooves by the burrs 3*a*, 3*b* attached to the three-dimensional ribs 3.

Although the present invention is described with respect to an example of condensation, it also exhibits the same effect with respect to the case of vaporization. That is, according to the above embodiments, since the refrigerant mixture is sucked into the auxiliary grooves, new concentration boundary layers are formed from the three-dimensional ribs and thus a high heat transfer coefficient can be also obtained in the case of vaporization.

Since an inclination angle is usually reduced in the heat transfer pipe according to the above embodiments, when the auxiliary grooves are made, as compared with a pipe with ordinary cross grooves, there can be achieved an effect that a job is carried out promptly with ordinary ease in the manufacturing process of the heat transfer pipe.

Next, a case that the heat transfer pipe according to the present invention is used for a heat exchanger for a refrigerant mixture will be described with reference to FIG. 12 to FIG. 16.

Figure 12:
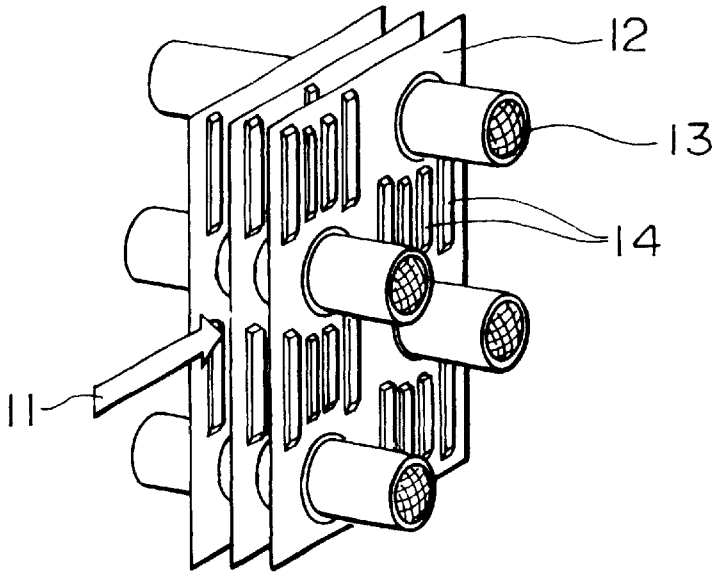
FIG. 12 is a perspective view of a cross fin tube type heat exchanger using the heat transfer pipe according to the present invention.

FIG. 12 shows a view of a heat exchanger called a cross fin tube type heat exchanger having a multiplicity of parallel fins 12 into which heat transfer pipes 13 are inserted. Louvers 14 are disposed on the surface of the fins 12 in many cases to improve a heat transfer coefficient on an air side. Air enters from a direction 11 in the drawing and flows among the fins. The heat transfer pipes of the above embodiments, in particular, the heat transfer pipes described in the second and third embodiments are preferable as the heat transfer pipes 13 used in the heat exchanger.

Figure 13:
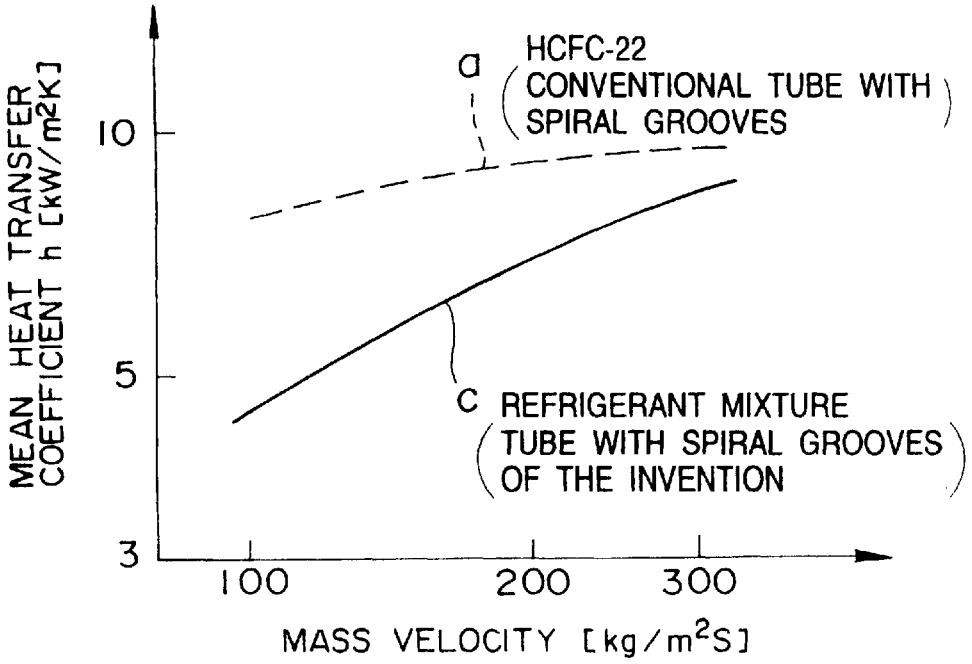
FIG. 13 is a graph comparing a performance of a conventional pipe with grooves using HCFC-22 and that of the heat transfer pipe according to the present invention using a refrigerant mixture.

FIG. 13 is a graph comparing a mean condensation heat transfer coefficient when HCFC-22 as a single refrigerant flows to a pipe with a single groove, with a mean condensation heat transfer coefficient when a refrigerant mixture flows to the pipe with the cross grooves described in the above embodiments. As apparent from FIG. 13, although there is no difference between both the mean condensation heat transfer coefficients when a mass velocity is about 300 $kg/m^2S$, when the mass velocity decreases to 100 $kg/m^2S$, the heat transfer coefficient is reduced even if the pipe with the cross grooves of the above embodiments is used. Thus, a method of preventing the reduction of the heat transfer coefficient is to use the heat transfer pipe in a region where the mass velocity is as large as possible.

Figure 14:
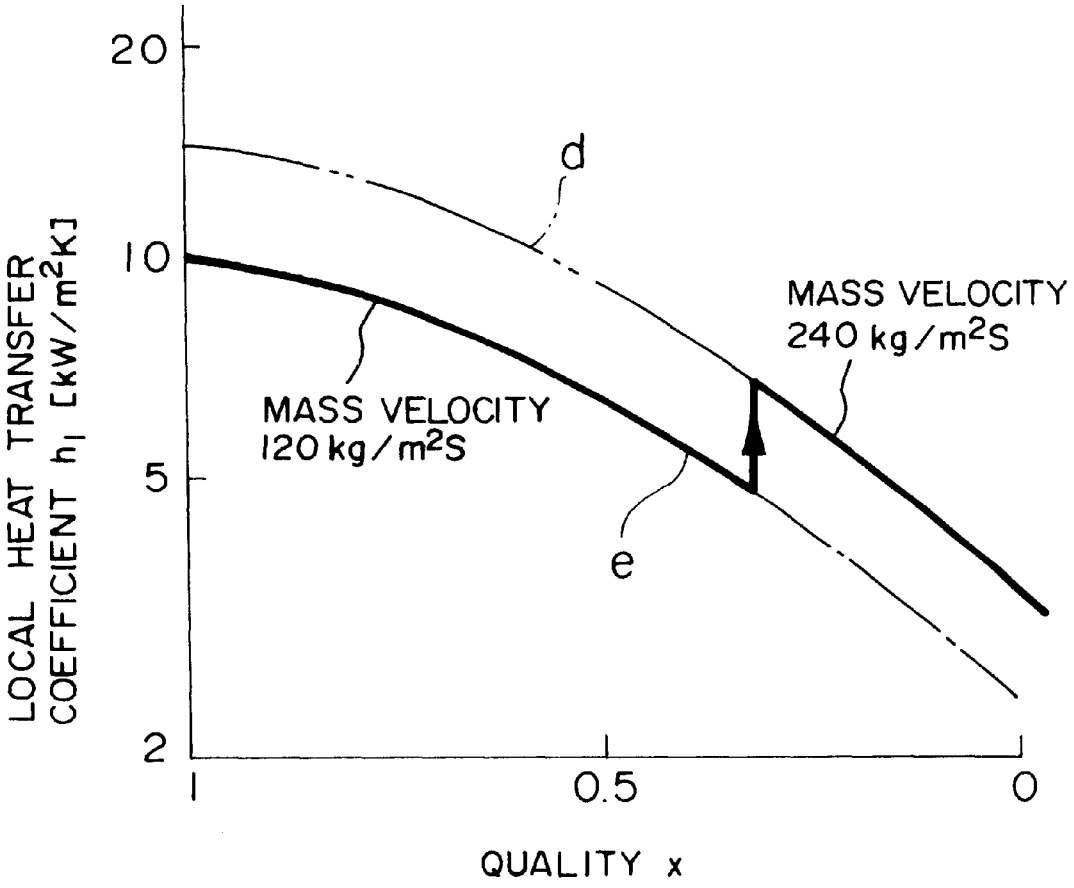
FIG. 14 is a graph showing the change of a heat transfer coefficient on the refrigerant side of a heat exchanger using the heat transfer pipe of the present invention.

FIG. 14 is a graph showing an effect of the mass velocity when a vapor quality is set to the abscissa and a local condensation heat transfer coefficient is set to the ordinate. When the vapor quality x is reduced, that is, when an amount of a liquid refrigerant is increased, the local condensation heat transfer coefficient is reduced. However, since a pressure loss is also small in a region having a small vapor quality, an amount a refrigerant flow can be increased. FIG. 14 shows an example that a refrigerant flows at a mass velocity of 120 $kg/m^2S$ in a region having a large quality and at a mass velocity of 240 $kg/m^2S$ in a region having a small quality. As described above, a high mean heat transfer coefficient can be obtained by changing the mass velocity in an intermediate portion of a refrigerant flow path.

Figure 15:
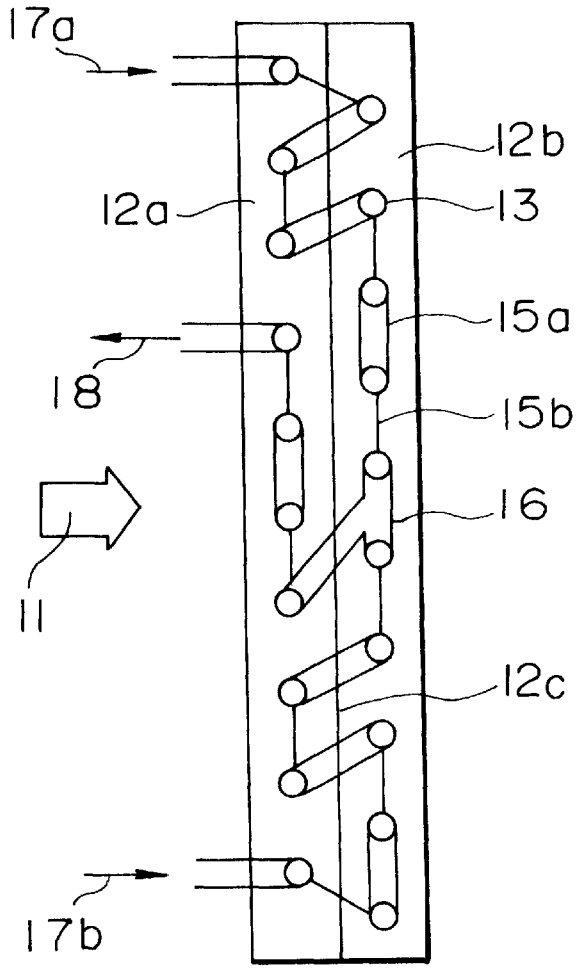
FIG. 15 is a side elevational view showing an example of the disposition of refrigerant paths of the heat exchanger using the heat transfer pipe of the present invention.
Figure 16:
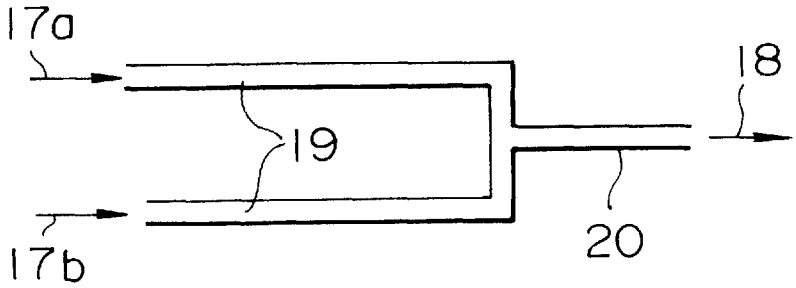
FIG. 16 is a schematic view showing the change of the number of refrigerant paths of the heat exchanger of FIG. 15.

The mass velocity can be changed in the intermediate portion of the refrigerant path by changing the number of refrigerant paths, an example of which is shown in FIG. 15. Gas refrigerants enter from two refrigerant inlets 17*a* and 17*b* and reach a joint pipe 16 through a return bend 15*a* and a hair pin bend 15*b*. The gas refrigerants having joined there flow at a high mass velocity in refrigerant pipes as a single path and reach a refrigerant outlet 18. FIG. 16 schematically shows this behavior of the gas refrigerants and it is found from the drawing that the refrigerant paths change from two paths to one path.

A division slit 12*c* is provided with a fin shown in FIG. 15. The division slit 12*c* has a purpose of preventing heat transfer effected through the fin because a temperature changes in a process of condensation and vaporization when a refrigerant mixture is used.

When the heat transfer pipes of the above embodiments are assembled to a cross fin type heat exchanger as shown in FIG. 12, the heat transfer pipes must come into intimate contact with the fins. For this purpose, the heat transfer pipe is conventionally expanded mechanically by a mandrel in many cases. However, since the heat transfer pipe of the above embodiments has a complex configuration, if it is expanded in such a way, there is a fear that the performance of the pipe is greatly deteriorated because it is deformed by the mechanical expansion. Therefore, it is preferable to use a fluid pressure expanding method to expand the heat transfer pipe of the above embodiments.

According to the present invention, a refrigerant flow along the main grooves in the heat transfer pipe with cross grooves for a refrigerant mixture can be bent in the direction of the auxiliary grooves and as a result a heat transfer pipe for a refrigerant mixture having a high heat transfer coefficient can be provided. FIG. 9 shows an example of the present invention, wherein the curve b shows the result of experiment of the conventional pipe with a single groove and the curve c shows the result of experiment of the pipe with cross grooves of the present invention. It is apparent from FIG. 9 that the heat transfer coefficient is improved in the wide range of the mass velocity.

Further, according to the present invention, since the mass velocity can be kept at a speed as higher as possible by changing the number of the refrigerant paths in an intermediate portion of a heat exchanger, a heat exchanger for a refrigerant mixture having a high heat transfer performance can be provided.

What is claimed is:

1. A heat transfer pipe used for a condenser and an evaporator in a refrigerating cycle using a refrigerant mixture, comprising main grooves and auxiliary grooves each formed on the inner surface of said heat transfer pipe with said main grooves intersecting said auxiliary grooves, wherein said main grooves are separated by ridges, and said ridges are divided into ribs by said auxiliary grooves, wherein a length of said ribs formed along the direction of said main grooves is made longer than a width of said ridges, a width of said auxiliary grooves is made smaller than the length of said ribs and further said auxiliary grooves are formed in a direction where a pressure gradient in said heat transfer pipe is reduced, and wherein convex deformed portions are formed in each of said ribs to cause a refrigerant flow along said main grooves to bend in the direction of said auxiliary grooves.

2. A heat transfer pipe according to claim 1, wherein said main grooves are formed by being inclined at an angle in a range from 7° to 25° with respect to said pipe axis.

3. In a refrigerating comprising a refrigerating cycle using a refrigerant mixture flowing through a condenser and an evaporator, the improvement comprising at least one of said condenser and evaporator including a heat transfer pipe formed on an inner surface with main grooves and auxiliary grooves intersecting with said main grooves, wherein said main grooves are separated by ridges, and said ridges are divided into ribs by said auxiliary grooves, wherein a length of said ribs formed along the direction of said main grooves made longer than a width of said ridges, a width of said auxiliary grooves is made smaller than the length of said ribs and further said auxiliary grooves are formed in a direction where a pressure gradient in said heat transfer pipe is reduced, and wherein convex deformed portions are formed in each of said ribs to cause a refrigerant flow along said main grooves to bend in the direction of said auxiliary grooves.

4. A refrigerating apparatus according to claim 3 wherein said main grooves are formed by being inclined at an angle in a range from 7° to 25° with respect to said pipe axis.

* * * * *